United States Patent [19]

Largeteau

[11] 4,275,530

[45] Jun. 30, 1981

[54] GRINDING HEADS FOR GRINDING MACHINES

[75] Inventor: Pierre A. Largeteau, Bezons, France

[73] Assignees: Societe Anonyme Automobiles Citroen; Automobiles Peugeot, both of Paris, France

[21] Appl. No.: 17,079

[22] Filed: Mar. 2, 1979

[30] Foreign Application Priority Data

Mar. 6, 1978 [FR] France ..... 78 07211

[51] Int. Cl.[3] ..... B24B 5/00

[52] U.S. Cl. ..... 51/355; 51/340; 51/346; 51/350; 51/DIG. 6

[58] Field of Search ..... 51/1, 338, 339, 346, 51/349, 350, 355, 363, 372, 373, 375, DIG. 6, 34 R, 340

[56] References Cited

U.S. PATENT DOCUMENTS

| | | | |
|---|---|---|---|
| 1,452,769 | 4/1923 | Warner | 51/1 |
| 2,044,474 | 6/1936 | Groetchen | 51/372 |
| 2,268,479 | 12/1941 | Gjertsen | 51/339 |
| 2,411,545 | 11/1946 | Kline | 51/355 |
| 2,702,446 | 2/1955 | Johnson | 51/375 |
| 3,605,348 | 9/1971 | McClure | 51/338 |

*Primary Examiner*—Harold D. Whitehead
*Assistant Examiner*—K. Bradford Adolphson
*Attorney, Agent, or Firm*—Karl F. Ross

[57] ABSTRACT

A grinding head has at least one expandable grinding tube mounted on an expansion cone. The expansion cone is carried by, and is rotatable with, an expansion rod which is coupled for rotation with a driven part of the head. The expansion rod and cone are movable by means of a ram to cause expansion and contraction of the grinding tube. The connection between the ram and expansion cone via the expansion rod includes helical coupling means whereby to cause a step-down in the effective stroke of the ram as applied to the expansion cone, which enables high accuracy in the expansion and contraction of the grinding tube.

13 Claims, 9 Drawing Figures

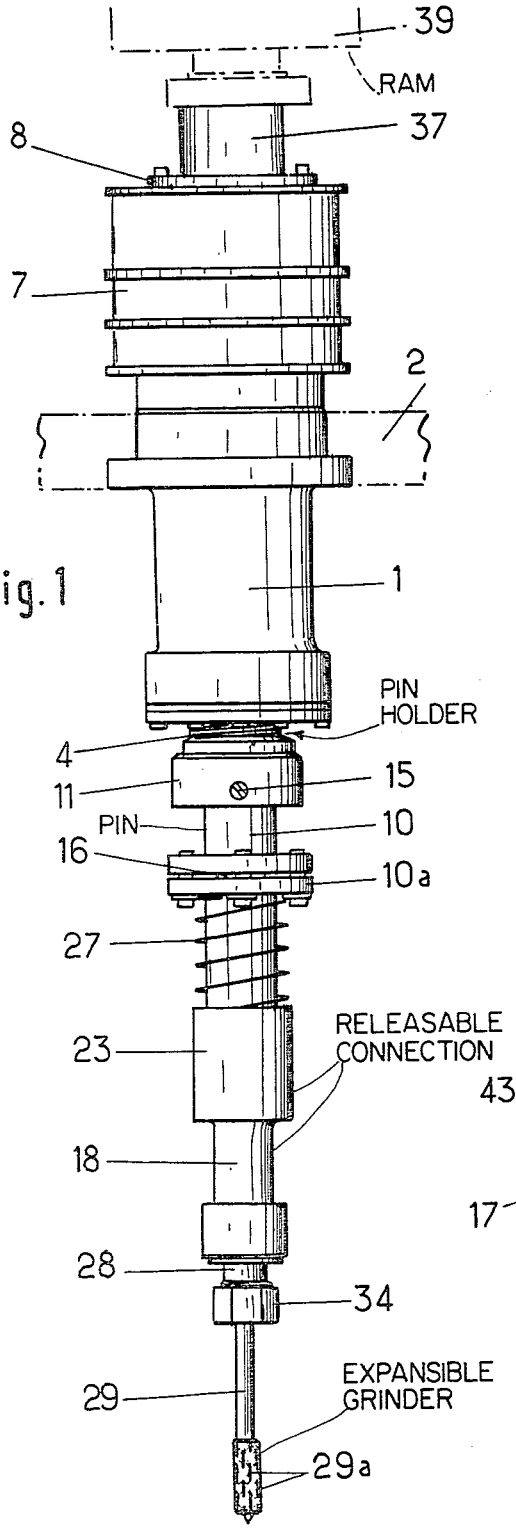
Fig. 1
Fig. 3
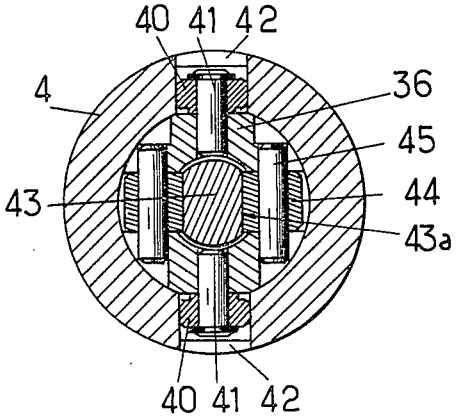
Fig. 4
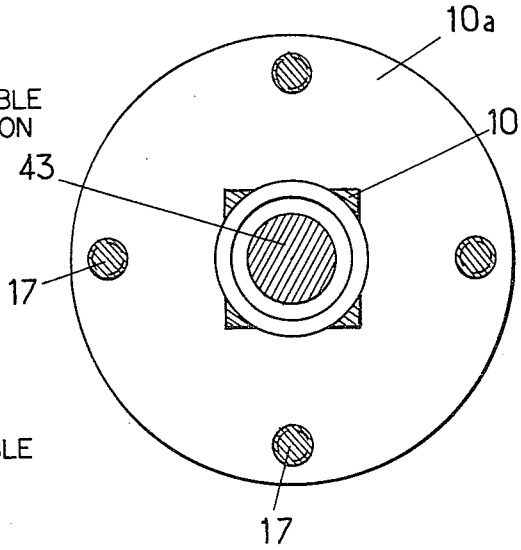

FIRST HELICAL COUPLING MEANS
1
43a
42
43
4
PIN HOLDER
SECOND HELICAL COUPLING MEANS
43b
6
46
THREADED PART OF EXPANSION ROD
12
EXPANSION ROD
14
13
11
15
PIN
10
16
IV
10a
IV
17
43
27
RESILIENT MEANS
25
23

GRINDING HEADS FOR GRINDING MACHINES

BACKGROUND OF THE INVENTION

1. Field of the Invention.

The invention relates to grinding machines and more particularly to grinding heads of such machines.

2. Description of the Prior Art.

Grinding machines are known which permit obtaining gauged bores with very small tolerances. However, if it is desired to eliminate inlet and outlet defects in a very precise manner, it is necessary to insert and remove the grinder in a contracted state, which requires an automatic expansion control. This control must be both fast and very accurate because it should be able to impart to the grinder the diameter it had during the previous operating stroke, with an accuracy of less than one tenth of a micron. Automatic grinders at present in existence do not permit making recessed bores with tolerances of less than one micron.

SUMMARY OF THE INVENTION

According to the invention, there is provided a grinding head comprising at least one expandible grinder, an expansion cone on which the grinder is mounted, a pin, a grinder holder, a pin holder, means mounting the grinder holder to pivot freely on the pin while preventing relative axial movement between the grinder holder and the pin, a ram, an expansion rod, a coupling member, the expansion cone being coupled to the ram through the expansion rod and the coupling member, a drive-transmitting connection for connecting the coupling member to the pin holder so as to be driven in rotation by the latter while permitting axial movement relative thereto, first helical coupling means connecting the expansion rod to the coupling member in such a manner that the rod is fixed for rotation with the coupling member and the latter causes said rod to pivot relative to the coupling member and to the pin holder when it is moved axially, and second helical coupling means connecting the expansion cone, the expansion rod and the pin in such a manner that the cone is fixed for rotation with the rod and is, in addition, displaced axially when said rod pivots relative to the pin holder, and to the pin.

In operation, the expansion cone is driven in rotation by the pin holder, via the coupling member, the first helical coupling means, the expansion rod, and the second helical coupling means. As for the grinder, this is driven in rotation exclusively by the expansion cone, as the grinder holder is able to pivot freely relative to the pin. The grinder thus receives an evenly distributed friction couple, which prevents it from becoming laterally deformed.

When the ram is pressurized or otherwise actuated, the coupling member moves axially, which causes the expansion rod to pivot as a result of the action of the first helical coupling means. The rod, on pivoting, moves the expansion cone axially via the second helical coupling means.

The use of double helical means permits a high step-down ratio of the expansion stroke, and thus, with a ram of standard type, a very high accuracy in the expansion of the grinder.

The expansion rod may, for example, comprise a part which is mounted so as to slide in the coupling member and comprises at least one peripheral helical ramp cooperating with a roller the shaft of which is carried by the coupling member. The latter thus moves the rod through the roller. Moreover, when the coupling member moves axially, the roller rolls on the helical ramp of the rod and causes the pivoting of the rod relative to the coupling member.

In an advantageous embodiment of the invention, the expansion cone is fixed at the end of a threaded part screwed into a casing which is fixed for rotation with the pin, and relative to which the grinder holder is able to rotate freely, and the expansion rod has a part of non-circular section, for example polygonal, which is slidably mounted in a central perforation of corresponding section, of the threaded part.

In operation, the expansion rod drives the threaded part in rotation, but as the casing is moved in rotation at the same speed, the threaded part remains motionless relative to the casing; there is no axial displacement of the expansion cone. On the other hand, when the ram is actuated, as a consequence, the expansion rod pivots relative to the pin, and thus relative to the casing, the threaded part moves axially, moving the expansion cone.

As it is the thread of the casing which ultimately determines the stroke of the expansion cone, axial play or expansion between the grinder tube and the expansion rod have no effect upon this stroke. Moreover, as a result of the rotary transmission opposed to the effect of the resistant couple, there is a permanent taking up of play at the level of the thread, and it is not necessary to provide a positive stop.

Preferably, the casing is mounted so as to be releasable from the pin, if desired. It is then possible to cause the casing to pivot relative to the pin, and therefore relative to the expansion rod. During this movement, the threaded part remains immobilized by the expansion rod, so that it moves axially taking the expansion cone along. It is thus possible to modify the initial adjustment of the expansion. This adjustment is very precise: thus, a pivoting of the casing by an angle of 5° to 10° causes the diameter of the grinder to vary only by a value of the order of two tenths of a micron.

To effect good guidance of the expansion rod, the latter may comprise a threaded portion screwed into the pin, either directly, or by means of a threaded sleeve, and, in addition, externally threaded.

To effect its driving by the pin holder, the coupling member may bear at least one roller which is engaged into a longitudinal groove of the pin holder.

The grinder is preferably a grinding tube as described in French patent application No. 77 37677. See U.S. application Ser. No. 954,487 filed Oct. 25, 1978 now U.S. Pat. No. 4,223,485. The tube comprises an external active diamond part, provided with slits so as to be expandible, with the slits being disposed according to generatrices of the grinding tube in such a manner that there are two or more slits on the same generatrix, with the slits alternating in offset arrangement from one generatrix to the next.

BRIEF DESCRIPTION OF THE DRAWING

An embodiment of the invention, will now be described, by way of example only, with reference to the accompanying diagrammatic drawing, in which:

FIG. 1 is an elevation of a grinding head in accordance with the invention;

FIG. 3 is a cross-section taken on line III—III of FIG. 2*a;*

FIG. 4 is a cross-section taken on line IV—IV of FIG. 2*b;*

DESCRIPTION OF THE PREFERRED EMBODIMENT

Figure 2A:
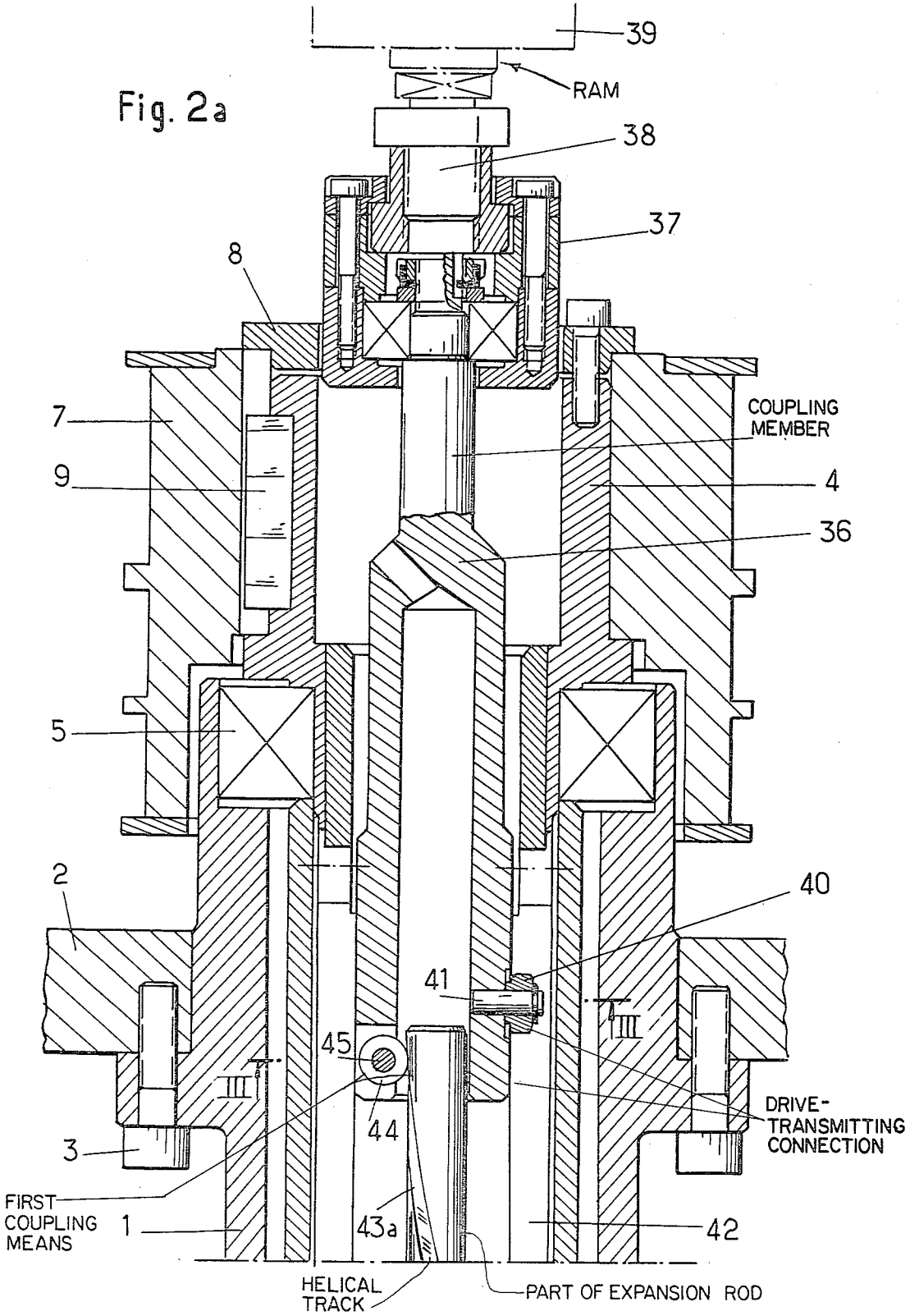
FIG. 2*a* is an axial section of the upper part of the head.

The grinding head comprises a body 1 which is fixed on a supporting plate 2 by means of bolts 3 (FIG. 2*a*). A pin holder 4 is rotatably mounted in the body 1 by means of bearings 5 and 6. A driving pulley 7 is disposed around the upper end of the pin holder 4, being held by a part 8 and fixed for rotation with the pin holder by means of a key 9.

Figure 2B:
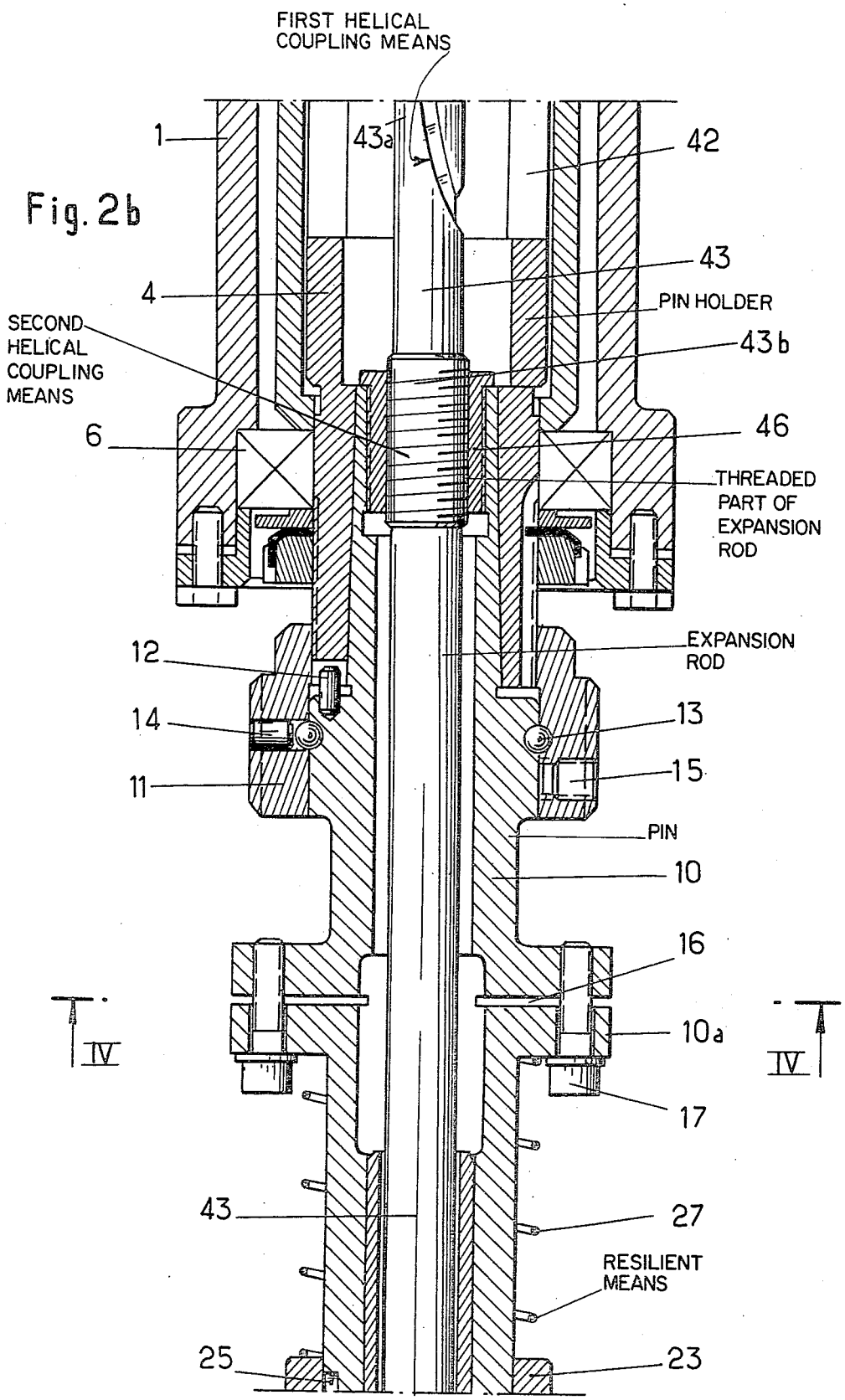
FIG. 2*b* is an axial section of the central part of the head.

An upper conical end of a pin 10 is inserted into a conical bottom end of the pin holder 4 and is held by a lock nut 11. A driving piece 12 is interposed between the pin holder and the pin. The nut 11 is rotatably mounted on the pin by means of balls 13 housed partly in an external groove of the pin and partly in an internal groove of the nut. A hole is made radially in the nut to permit the insertion of the balls 13, and is sealed by a screw plug 14 (FIG. 2*b*). A locking screw 15 serves to secure the nut in position on the pin. The pin 10 has a flange 10*a* provided with an annular radial slit 16 through which screws 17 pass, which permits slight misalignments of the longitudinal axis of the pin to be corrected.

Figure 5:
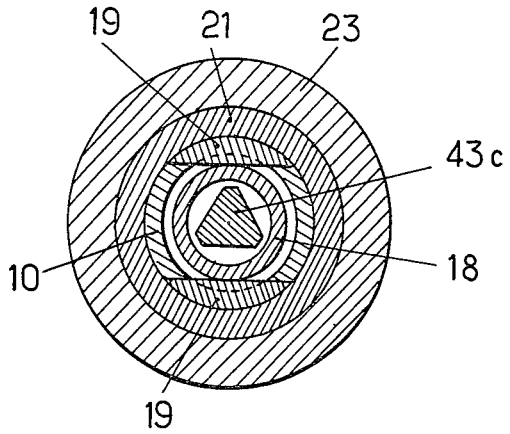
FIG. 5 is a cross-section taken on line V—V of FIG. 2*c;*
Figure 6:
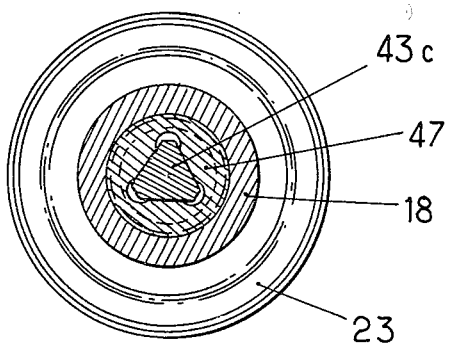
FIG. 6 is a cross-section taken on line VI—VI of FIG. 2*c;*.
Figure 7:
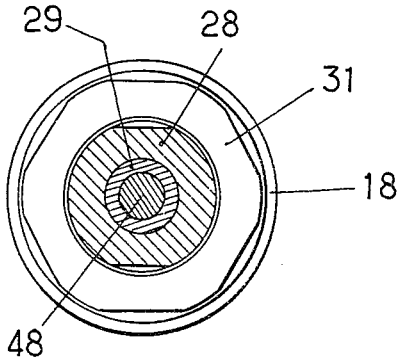
FIG. 7 is a cross-section taken on line VIII—VIII of FIG. 2*c.*

A cylindrical casing 18 (FIG. 2*c*) is inserted axially into the bottom part of the pin 10 and is made fast for axial movement with the pin by means of key means formed by and two keys 19 engaged in the pin and touching tangentially the bottom of a circular groove 20 formed in the external part of the casing (FIG. 5). These keys are held in position by a bushing 21 which is held by a circlip 22 disposed in a groove at the end of the pin 10.

A ring 23 is slidably mounted on the bottom end of the pin. An insert 24 is disposed radially in the ring 23; this insert ends in two flat portions 24*a* parallel with the axis and engaged in a longitudinal groove 25 of the pin, which permits the ring to slide longitudinally relative to the pin, while effecting its drive by the pin. The groove 25 is closed at its bottom end by the bushing 21 and the insert 24 is held in position by a resilient retaining ring 26 disposed in two concentric grooves. A spring 27 interposed between the ring and the collar 10*a* of the pin tends to hold the ring 23 in a lowermost position in which the part 24 is in contact with the bush 21. The ring 23, has at its bottom part, a female notched part cooperating with a male notched part of the casing 18 forming a releasable connection when the ring is in its lowermost position.

It is thus seen that the casing 18 is normally driven in rotation by the pin, through the ring 23, but, by lifting this against the action of resilient means in the form of the spring 27, the two pieces are disconnected and it is then possible to rotate the casing relative to the pin.

A clamping sleeve or grinder holder 28 for a grinding tube 29 is rotatably mounted in the bottom portion of the casing 18, through a bearing 30. This bearing is held axially on the one hand in the casing by the threaded sleeve 31 screwed into the casing and, on the other hand, on the clamping sleeve 28 by a washer 32 which is held by a circlip 33 housed in a groove of the sleeve.

A lock nut 34 screwed on the bottom end of the sleeve 38 holds in the sleeve 38 a clamp 35 for the grinding tube or grinder 29.

The working part of the grinding tube 29 includes diamonds and, to enable the working part to be expanded and contracted, is provided with slits 29*a* which are disposed according to the generatrices of the tube and which are separated in such a manner that there are two or more slits along the same generatrix, with the slits of adjacent generatrices being offset (see FIG. 1).

A coupling member 36 disposed within the pin holder 4 on the axis thereof is connected by a rotating connection 37 to a piston rod 38 of a fluid-actuated ram 39 (FIG. 2*a*). The body of the ram is rigid with the plate 2, and the ram is actuated by means not shown in the drawing, to reciprocate the coupling member and the parts connected thereto along the axis of the pin. At its bottom end, the member 36 bears rollers 40 which are mounted on shafts 41 and engaged in grooves 42 of the pin holder 4. Rollers 40 and grooves 42 thus form a drive transmitting connection between pin holder and coupling member. The member 36 is thus driven in rotation by the pin holder, but can, in addition, be displaced axially by the ram 39.

The coupling member 36 is cut away at the bottom and contains an expansion rod 43 which passes through the pin 10 and is provided with a part having two peripheral helical tracks 43*a* which are diametrically opposed. In contact with these tracks are rollers 44 which are mounted on shafts 45 supported by the member 36. As a result of this arrangement, i.e. the first helical coupling means the axial displacement of the member 36 consequent on the action of the ram 39, causes rotation of the expansion rod 43 relative to the pin 10.

The expansion rod 43 comprises a threaded part 43*b* which is engaged in a threaded wearing part 46, the latter being threaded externally and being screwed into the pin 10.

Figure 2C:
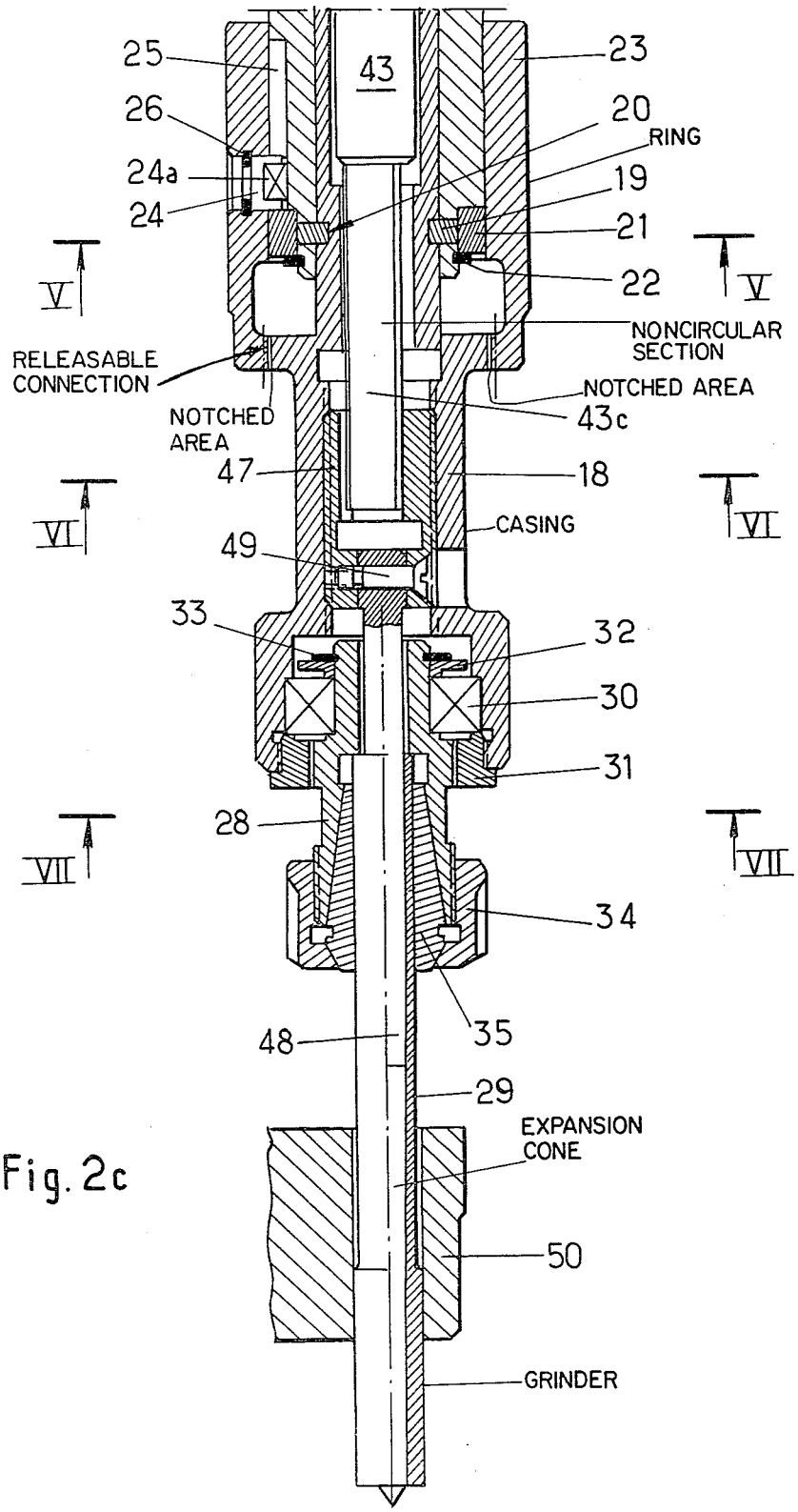
FIG. 2*c* is an axial section of the lower part of the head.

At its bottom portion 43*c* the rod 43 has a polygonal noncircular section, for example triangular, which is engaged in a central bore of sleeve 47 screwed into the casing 18. An expansion cone 48 of the grinding tube 29 is engaged in the sleeve 47 and locked by a transverse screw 49 (FIG. 2*c*).

Reference numeral 50 denotes the workpiece to be ground.

The grinding head which has just been described operates as follows:

In operation, the casing 18 is driven in rotation by the pulley 7, through the pin holder 4, the pin 10 and the ring 23. The expansion rod 43 and the sleeve 47 are driven at the same speed by the pin holder 4 and the coupling member 36. The casing 18 and the sleeve rotate at the same speed, and thus there is no axial displacement of the sleeve relative to the casing. The sleeve 47 moves the expansion cone 48 which, in its turn, entrains by friction the grinding tube 29.

When the ram 39 is pressurized, the coupling member 36 moves downwards, which causes the pivoting of the rod 43. The latter rotates the screwed sleeve 47 (second helical coupling means) relative to the casing 18 whereby the sleeve 47 moves downward but with a stroke which is only a very small fraction of the stroke of member 36. The expansion cone 48 follows the axial movement of the sleeve 47 which brings about the expansion of the grinder 29.

To effect the initial adjustment of the expansion, with the machine stopped, it will suffice to raise manually the notched ring 23 so as to free its notches from the notches in the casing 18, which frees the casing from rotation with the pin 10. Then, the casing 18 is rotated in one direction or the other, so that the screwed sleeve 47 moves axially, together with the expansion cone 48, the result of this being the expansion or contraction of the grinding tube.

In a practical example, the casing 18 and the ring 23 each have 48 angularly-spaced notches so that each angular movement of the ring relative to the casing 18 by one notch, that is to say an angular displacement of 7° 30′, corresponds to a change of two tenths of a micron in the diameter of the grinding tube 29.

By suitably selecting the pitch of the thread of the sleeve 47 and that of the corresponding thread on the casing 18, it is possible to adapt the expansion to the required amount, for one and the same stroke of the ram 39.

The grinding head described may be used in grinding machines having provision for only one grinding head, or for machines having provision for two or more grinding head.

The automatic grinding head particularly described permits a very high degree of accuracy, particularly in repetitive expansions, and may be used for making recessed bores.

The grinding head described is suitable in particular for the grinding of pump barrels, injectors or engine liners.

I claim:

1. A grinding head comprising:

an expandable grinder;

a tubular grinder holder supporting said grinder;

an expansion cone received in said grinder and axially displaceable therein to expand said grinder;

an expansion rod connected to said expansion cone and extending through said tubular grinder holder;

a ram remote from said expansion cone and operable to control expansion of said grinder;

a rotatable tubular drive pin surrounding said rod and operatively connected to said grinder for rotating same;

a coupling member operatively connected to said ram and rotatably and axially received in said pin holder;

first helical coupling means connecting said coupling member to said expansion rod for joint rotation of said expansion rod and said coupling member but for relative rotation of said expansion rod and said coupling member upon axial displacement of said coupling member by said ram; and second helical coupling means connecting said pin and said expansion rod for fixing said expansion rod and said cone for joint rotation with said expansion rod and for axially displacing said cone upon relative rotation of said expansion rod and said pin holder.

2. The grinding head defined in claim 1 wherein said first helical coupling means comprises at least one peripheral helical track on a part of the expansion rod received in said coupling membeer, and roller means carried by said coupling member and engaging said helical track.

3. The grinding head defined in claim 1, further comprising a casing fixed for rotation with said pin and relative to which said grinder holder can rotate freely, said second helical coupling means including a threaded sleeve screwed into said casing, said expansion cone being fixed to said threaded sleeve, said sleeve having a central bore of noncircular cross section, said expansion rod having a part of corresponding noncircular section slidable in said central bore.

4. The grinding head defined in claim 3, further comprising means forming a releasable connection between said pin and said casing enabling said casing to be freed from said pin.

5. The grinding head defined in claim 4 wherein said means forming said releasable connection includes a notched area formed on said casing, a ring keyed to said pin and slidable thereon while having a notched area engageable with the notched area in said casing, and resilient means tending to hold the notched areas in mutual engagement.

6. The grinding head defined in claim 5, further comprising an insert disposed radially in said ring, retaining means holding said insert in position, and means defining a longitudinal groove in said pin, said insert being received in said longitudinal groove.

7. The grinding head defined in claim 3, further comprising means defining a circular groove in said casing and a key engaged in said pin and said circular groove for securing said casing to said pin for axial movement therewith.

8. The grinding head defined in claim 7, further comprising a bushing for retaining said key means in position, means defining a circular groove in said pin, and a circlet in said circular groove for retaining said bushing.

9. The grinding head defined in claim 3, further comprising a clamping sleeve connecting said grinder to said casing.

10. The grinding head defined in claim 1 wherein said second helical coupling means includes a threaded portion of said expansion rod screwed into said pin.

11. The grinding head defined in claim 1 wherein said second helical coupling means comprises a tapped threaded sleeve, said expansion rod having a threaded portion screwed into said sleeve, said sleeve being threaded into said pin.

12. The grinding head defined in claim 1, further comprising at least one roller on said coupling member, and means defining a longitudinal groove in said pin holder, said roller being engaged in said longitudinal groove.

13. The grinding head defined in claim 1 wherein the grinder comprises a grinding tube having an external active diamond part provided with slits, so as to be expansible, the slits being disposed according to generatrices of the grinding tube with two or more slits along the same generatrix, the slits of adjacent generatrices being arranged in an alternating offset arrangement.

* * * * *